US008561861B2

(12) United States Patent
Muehlen

(10) Patent No.: US 8,561,861 B2
(45) Date of Patent: Oct. 22, 2013

(54) COMBINATION NURSING DEVICE AND BABY CARRIER

(76) Inventor: Vivian Muehlen, Kirkland, WA (US)

( * ) Notice: Subject to any disclaimer, the term of this patent is extended or adjusted under 35 U.S.C. 154(b) by 393 days.

(21) Appl. No.: 12/899,396

(22) Filed: Oct. 6, 2010

(65) Prior Publication Data

US 2011/0079622 A1 Apr. 7, 2011

Related U.S. Application Data

(60) Provisional application No. 61/249,232, filed on Oct. 6, 2009.

(51) Int. Cl.
*A47D 13/02* (2006.01)

(52) U.S. Cl.
USPC ..... 224/160

(58) Field of Classification Search
USPC ..... 224/158–161, 575, 646–649, 608
See application file for complete search history.

(56) References Cited

U.S. PATENT DOCUMENTS

| | | | | |
|---|---|---|---|---|
| 2,597,948 | A * | 5/1952 | Phillips | 224/575 |
| 5,205,450 | A * | 4/1993 | Derosier | 224/161 |
| 5,429,593 | A * | 7/1995 | Matory | 602/79 |
| 5,678,739 | A * | 10/1997 | Darling et al. | 224/160 |
| 5,685,466 | A * | 11/1997 | Hsieh | 224/160 |
| 2004/0139526 | A1 * | 7/2004 | Davis | 2/69 |
| 2004/0149790 | A1 * | 8/2004 | Kassai et al. | 224/160 |
| 2006/0261104 | A1 * | 11/2006 | Zambrzycki | 224/158 |
| 2007/0029356 | A1 * | 2/2007 | Moriguchi et al. | 224/160 |

* cited by examiner

*Primary Examiner* — Nathan J Newhouse
*Assistant Examiner* — Todd Anderson
(74) *Attorney, Agent, or Firm* — Stuart J. West; Shaun Shuman; West & Associates, A PC

(57) ABSTRACT

A baby nursing and carrying device, specifically one that allows a mother to switch breasts when breastfeeding a baby while still remaining covered and while still supporting the baby. When not in use for breastfeeding purposes, a mother can use the device for easily carrying the baby without strain on the mother's back and without having to support the baby with her hands, thus allowing the mother's hands to be free to do other things.

12 Claims, 4 Drawing Sheets

COMBINATION NURSING DEVICE AND BABY CARRIER

CLAIM OF PRIORITY

The following application claims priority to U.S. Provisional Patent Application No. 61/249,232, filed Oct. 6, 2009, the complete contents of which are hereby incorporated by reference.

BACKGROUND

1. Field of the Invention

The present disclosure relates to the field of child care devices, specifically a combination nursing device and baby carrier.

2. Background

In modern society, some mothers choose to refrain from breastfeeding their babies. However, for those that do nurse their babies, breastfeeding up to every one or two hours can become a challenging endeavor. When in public, mothers need to cover their exposed breast while nursing. This can become even more of a challenge when a mother needs to switch breasts mid-feeding, which is recommended by many medical professionals. Holding a baby, covering one breast, exposing the other, and repositioning the baby can be difficult and annoying, especially when a mother is trying to keep her breasts covered. Moreover, carrying the baby when it is not feeding can put strain on a mother's back and prevent her from using her hands to accomplish other tasks.

Therefore, it is desirable to have a device that can be used for both breastfeeding and carrying a baby. What is needed is a device that can be worn over the shoulders, similar to a backpack, but which has a baby support pouch that can be adjusted when a mother switches breasts while nursing. The support pouch should be adapted to selectively engage either shoulder strap, such that a baby can be repositioned while continuing to be supported and while covering a mother's exposed breast during feeding. When a baby is not being nursed, the device should be adapted for use as a baby carrier, such that the user can carry a baby close to his or her body without using hands to support the child. The device should also be easy to clean and store when not in use.

DETAILED DESCRIPTION

Figure 1:
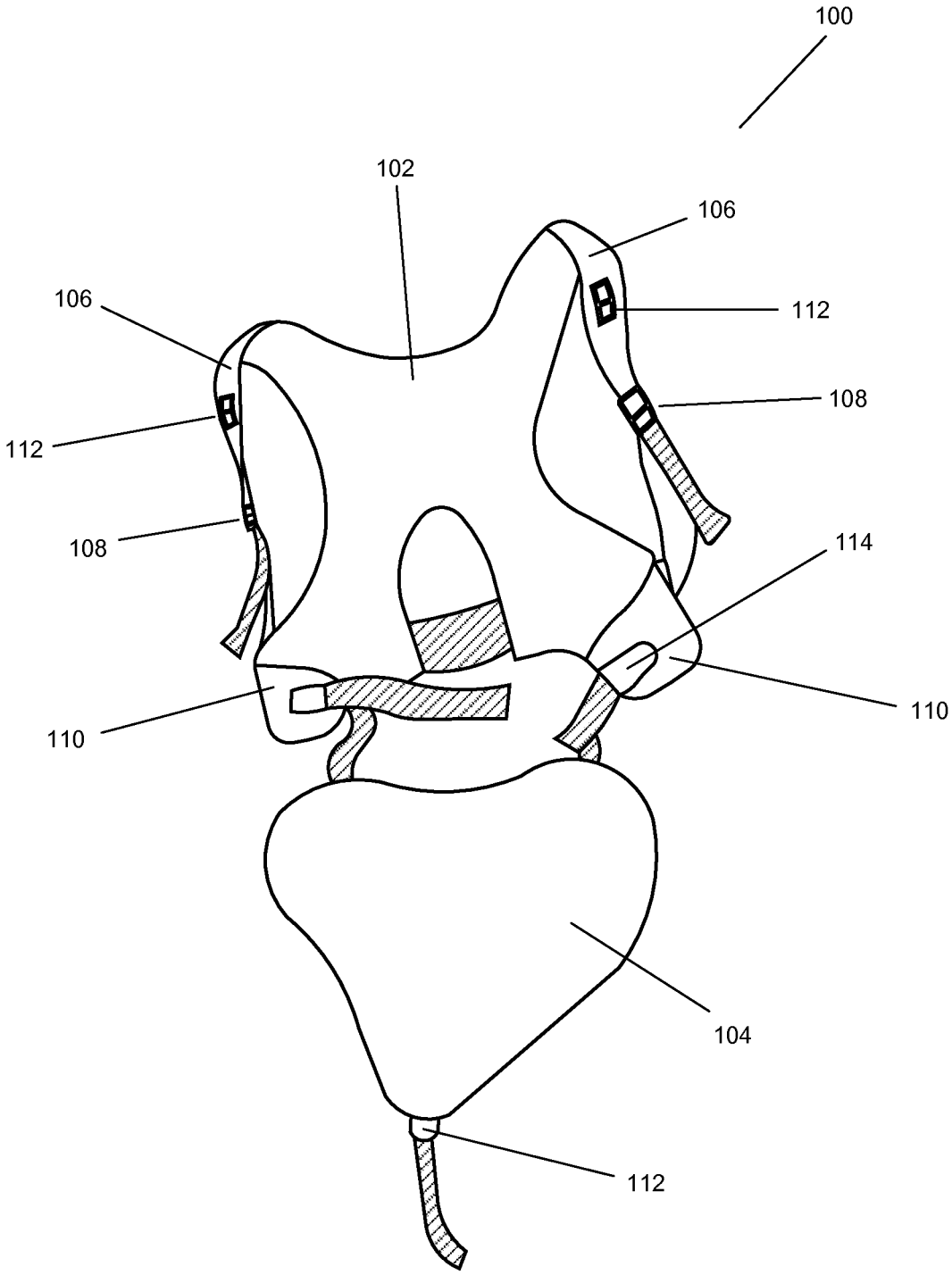
FIG. 1 depicts one embodiment of the present invention when not in use.
Figure 2:
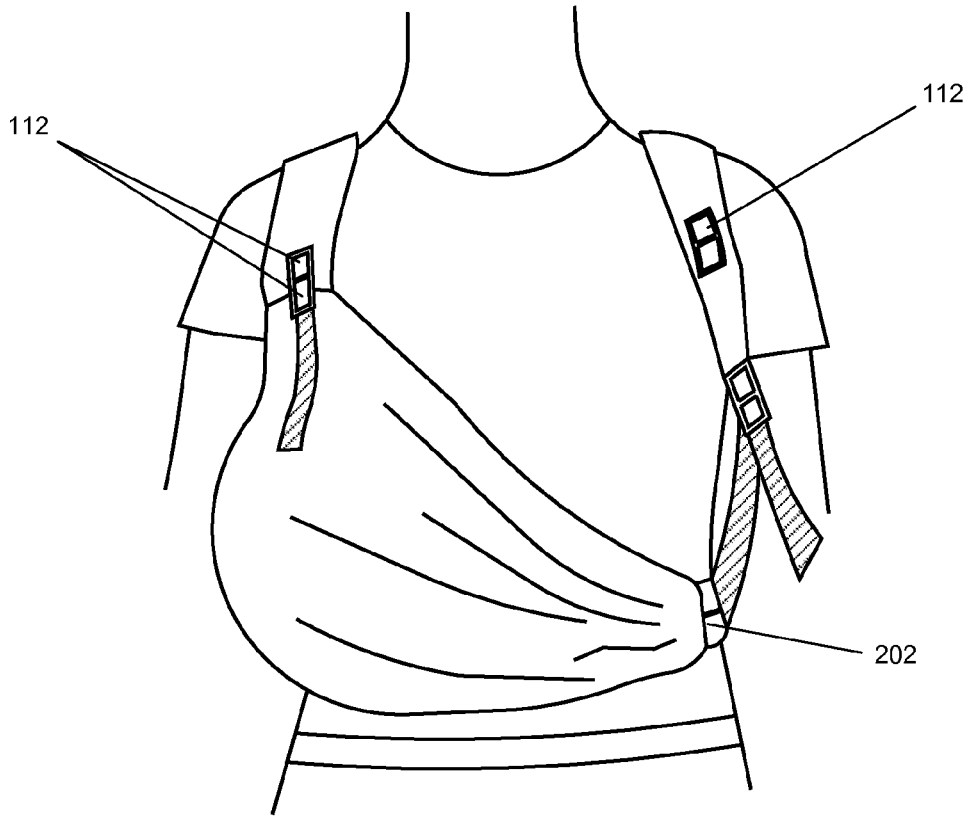
FIG. 2 depicts a front view of one embodiment of the present invention as worn by a user.
Figure 3:
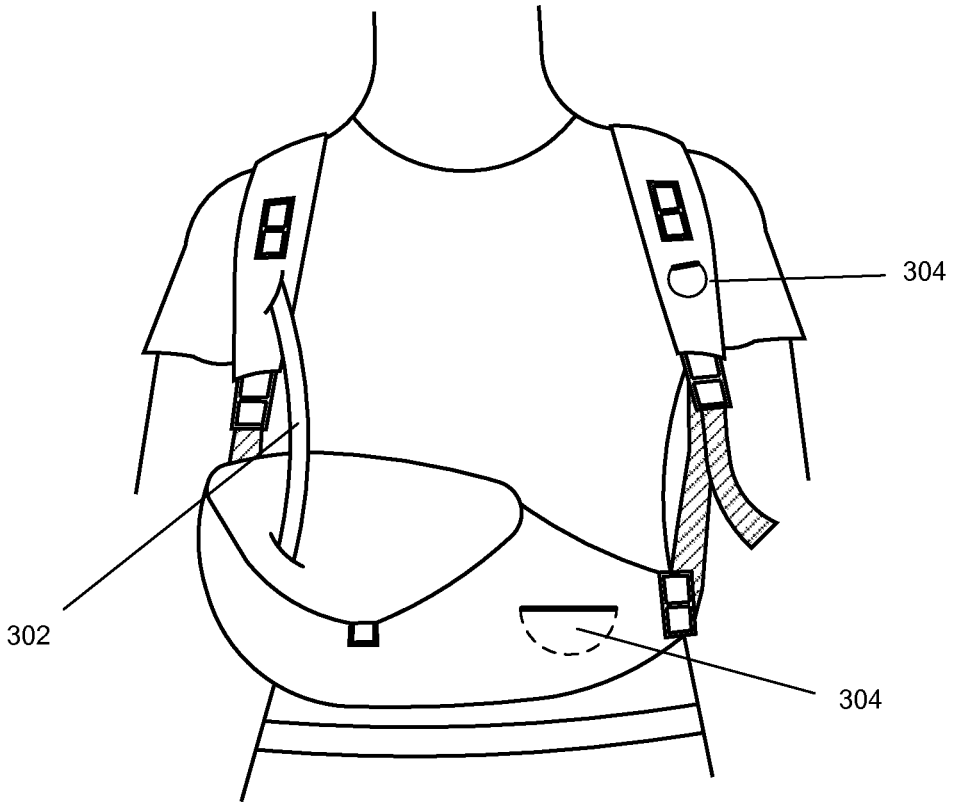
FIG. 3 depicts an alternate front view of one embodiment of the present invention as worn by a user.

FIG. 1 depicts one embodiment of a baby carrying and nursing device 100. A device 100 can comprise a back support 102 coupled with a baby support 104. A baby support 104 can be adapted to both support a baby and cover a mother's exposed breast while in use. A back support 102 can further comprise a plurality of shoulder straps 106, which can be worn over a user's shoulders like a backpack, as shown in FIGS. 2-4.

In the embodiment shown in FIG. 1, a back support 102 can be coupled with a plurality of shoulder straps 106 and waist straps 110. As depicted in FIG. 4, a back support 102 can cover a substantial portion of a user's back when in use. In other embodiments, a back support 102 can cover a larger or smaller portion of a user's back when in use. In some embodiments a back support 102 can be a substantially planar piece of flexible fabric, as shown in FIG. 4, while in other embodiments a back support 102 can comprise a plurality of support straps which can have any desired, comfortable, and/or supportive configuration. In yet other embodiments, a back support 102 can have any other known and/or convenient geometry and/or configuration.

A back support 102 can be made of fabric, nylon, polymer, or any other material or combination of materials. In some embodiments a back support 102 can be comprised of sueded polyester fabric, porous, semi-elastomeric fabric, fleece, moisture-wicking material, and/or any other known and/or convenient type of material. In yet other embodiments, a back support 102 can be comprised of a plurality of layers of material, and each layer can be different and/or can have different properties, or a back support 102 can have multiple layers of the same material. For example, in one embodiment a back support 102 can have a layer of insulating or water resistant material sandwiched between layers of mesh material. In yet other embodiments, a back support 102 can comprise a removable cooling or heating source, such as a gel pack that can be used to cool the user's body during hot weather. In some embodiments, at least one portion of a back support 102 can be padded for added comfort to its user.

Figure 4:
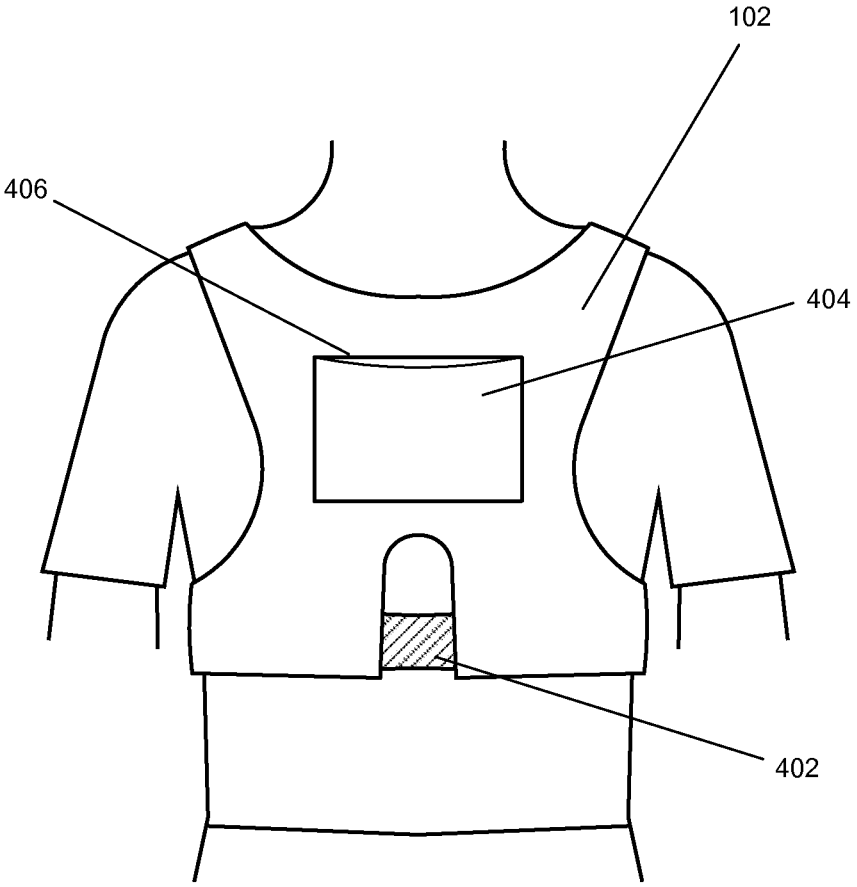
FIG. 4 depicts a back view of one embodiment of the present invention as worn by a user.

In other embodiments, as shown in FIG. 4, a back support 102 can have an elastomeric member 402 adapted to stretch and conform to a user's body shape when necessary and/or to enable a wide range of movement of the user. In alternate embodiments, a back support 102 can have any other known and/or convenient adjustment mechanism for conforming to a user's body and thus providing a back support 102 that is comfortable for users with different body types.

Shoulder straps 106 can be made of fabric, nylon, polymer or any other material or combination of materials. At least one shoulder strap 106 can be made of sueded polyester fabric, porous, semi-elastomeric fabric, fleece, moisture-wicking material, and/or any other known and/or convenient type of material. In yet other embodiments, a shoulder strap 106 can be comprised of a plurality of layers of material, and each layer can be different and/or can have different properties, or a shoulder strap 106 can have multiple layers of the same material. For example, in one embodiment a shoulder strap 106 can have a layer of insulating or water resistant material sandwiched between layers of mesh material.

In some embodiments, at least one portion of shoulder straps 106 can have padding for added comfort when the device 100 is in use. In other embodiments a shoulder strap 106 can be made of non-skid material and/or can have a non-skid coating such that slippage off a user's shoulder is minimized. For example, in some embodiments, at least one shoulder strap 106 can be at least partially coated with silicone material. In other embodiments, a shoulder strap 106 can have at least one smooth surface. In yet other embodiments, a shoulder strap 106 can have at least one surface comprising ridges or other raised portions. Moreover, in some embodiments, a shoulder strap 106 can have anti-bacterial properties or at least a minimal degree of sun protection factor.

As depicted in FIG. 1, shoulder straps 106 can have at least one adjustment mechanism 108 for adjusting the lengths of the straps 106 to conform to a user's body. An adjustment mechanism 108 can be a buckle or any other known and/or convenient mechanism for adjusting strap 106 length. Each shoulder strap 106 can further comprise at least one fastener 112 for selectively coupling with a baby support 104, as discussed in further detail below.

As depicted in FIG. 1, a back support 102 can be coupled with at least one waist strap 110. Waist straps 110 can be adapted to selectively couple with a baby support 104. Waist straps 110 can further comprise at least one adjustment mechanism 114 adapted to selectively tighten waist straps 110 around a user's midsection. As shown in FIG. 1, a baby support 104 can be coupled with adjustment mechanisms 114 permanently, via sewing, adhesive or any other known and/or convenient permanent bonding method. In other embodiments and as shown in FIG. 2, a baby support 104 can be selectively coupled with waist straps 110, via complementary fastening components 202, such that a baby support 104 can be selectively separated from waist straps 110 and/or a back support 102. In alternate embodiments, a strip of material can be coupled with a baby support 104 and fed through an opening that can extend around the lower perimeter of a back support 102 and waist straps 110, thus allowing a user to properly reposition a baby support 104 by sliding the strip of material around a user's midsection.

A baby support 104 can have a substantially triangular geometry when laid out, as shown in FIG. 1. In other embodiments, however, a baby support 104 can be rectangular, ovular, or trapezoidal in geometry, or can have any other desired and/or convenient configuration. A lower portion of a baby support 104 can be coupled with a back support 102 as depicted in FIGS. 1-3. In the embodiment depicted in FIG. 2, a baby support 104 is made of elastomeric material, allowing it to conform to a baby and/or a user's body, thus holding the baby securely and preventing gaps between the baby support 104 and a user's body. In other embodiments, a baby support 104 can have elastomeric material only around its perimeter. In yet alternate embodiments, a baby support 104 can be made of fabric, nylon, polymer or any other known and/or convenient material or combination of materials, elastomeric or non-elastomeric. In some embodiments, a baby support 104 can be made of sueded polyester fabric, porous or mesh material, moisture-wicking material, and/or any other known and/or convenient type of material or combination of materials.

In yet other embodiments, a back support 102 can be comprised of a plurality of layers of material, and each layer can be different and/or can have different properties, or a back support 102 can have multiple layers of the same material. For example, in one embodiment a back support 102 can have a layer of insulating or water resistant material sandwiched between layers of mesh material. In some embodiments, a baby support 104 can be at least partially made of fleece or any other type of insulating material to keep a baby warm. In other embodiments, a baby support 104 can comprise a washable or disposable inner liner, and/or an entire baby support 104 can be detachable from the rest of a device 100 for washing or wiping clean.

In some embodiments, a baby support 104 can be made in a variety of sizes and can be interchangeable, such that different sizes and/or configurations of a baby support 104 can be used for different size babies. For example, a user can use the smallest available baby support 104 for her infant, but as the baby grows the user can interchange the smallest baby support 104 with a larger baby support 104. Additionally, in some embodiments a device 100 can have multiple interchangeable baby supports 104 having different aesthetic qualities, such as different patterns, embroidery, accessories, or any other desired quality.

A top portion of a baby support 104 can further comprise at least one fastener 112 adapted to selectively couple with fasteners 112 on shoulder straps 106, thus creating a sling or pouch in which a baby can be placed when the device 100 is in use. In some embodiments, a fastener 112 can also be an adjustment mechanism, allowing the top portion of a baby support 104 to be loosed or tightened relative to a shoulder strap 106 and against a user's body. In other embodiments, a baby support 104 can comprise separate adjustment mechanisms and fasteners 112. As depicted in FIG. 3, a device 100 can further comprise a safety mechanism 302. A safety mechanism 302 can be adapted to couple with any of a plurality of shoulder straps 106 and can provide added security when a user uncouples a baby support 104 from a shoulder strap 106 to move it to another shoulder strap 106, thus preventing a child from falling from the device 100 when it is being adjusted. In some embodiments, once a baby support 104 is properly coupled with another shoulder strap 106, a safety mechanism 302 can be moved and coupled with the other shoulder strap 106. In other embodiments, a safety mechanism 302 does not need to be repositioned. A safety mechanism 302 can be a length of material, as depicted, or can have any other known and/or convenient configuration. In some embodiments, a safety mechanism 302 can further comprise at least one fastener 112 adapted to couple with a complementary fastener 112 on a shoulder strap 106.

Adjustment mechanisms 108 114, fasteners 112, and/or complementary fastening components 202 can be quick-release buckles, ties, snaps, hook and loop, or any other known and/or convenient type of fastening or adjustment mechanism. In some embodiments, one or more of a back support 102, shoulder straps 106, waist straps 110 and a baby support 104 can further comprise an accessory 304 such as, but not limited to: a pocket for holding personal items; a baby wipe holder; a cell phone holder; and/or a hook for holding keys or other items (see FIG. 3). A back support 102 can also comprise a removable or permanent pack 404 (see FIG. 4) that can be used in a manner similar to a conventional backpack. In other embodiments, a pack 404 can be a pocket that can be coupled with a back support 102 along at least one edge 406 of the pocket 404, such that when not in use, a device 100 can be stuffed into a pocket 404 for compact, easy storage. In yet other embodiments, a device 100 can comprise disposable burping clothes or any other known and/or convenient accessory temporarily or permanently coupled with a device 100. A device 100 can also be washable or can have a washable cover (either a pocket 404 or an alternate cover or storage vessel). In some embodiments, a device 100 can be foldable into a compact size for storage and transport purposes.

As shown in FIG. 2, in use a device 100 can be placed on a user's body by slipping first and second shoulder straps 106 over a user's shoulders such that a back support 102 can lie against the user's back. A baby support 104 can then be coupled with waist straps 110 via complementary fastening components 202. Fasteners 112 on both a baby support 104 and a first shoulder strap 106 can be coupled such that a sling or pouch is formed in which a baby can be held, as depicted in FIG. 2. In this position, a mother's exposed breast can also be adequately covered while positioning or nursing her child. Once a user has properly fastened all components and adjusted the device 100 to conform to her body, a baby can be placed between a baby support 104 and a user's body. A user can then breastfeed and/or carry her baby without the need to support the baby with her hands. When a breastfeeding mother needs to switch breasts, and thus needs to reposition her baby, she can uncouple a baby support 104 from a first shoulder strap 106 and shift a baby support 104 such that it can be coupled with a second shoulder strap 106 via a fastener 112. In embodiments that include a safety mechanism 302, as depicted in FIG. 3, a safety mechanism can be repositioned once a baby support 104 is securely coupled with a second shoulder strap 106.

Although the invention has been described in conjunction with specific embodiments thereof, it is evident that many alternatives, modifications and variations will be apparent to those skilled in the art. Accordingly, the invention as described and hereinafter claimed is intended to embrace all such alternatives, modifications and variations that fall within the spirit and broad scope of the appended claims.

What is claimed is:

1. A combination nursing device and baby carrier, comprising:

a back support member coupled with a first shoulder strap comprising a first fastening component, a second shoulder strap comprising a second fastening component, and at least one waist strap; and a baby support member adapted to support the weight and size of a baby, said baby support member having a lower portion coupled with said at least one waist strap, and an upper portion comprising a shoulder fastening component configured to selectively engage one of said first fastening component and said second fastening component;

wherein said baby support member is configured to be in a first position when said shoulder fastening component is engaged with said first fastening component, and in a second position when said shoulder fastening component is engaged with said second fastening component;

wherein said baby support member has a substantially planar, triangular geometry having two vertices on said lower portion and a third vertex on said upper portion, and wherein the two vertices on said lower portion are coupled with said at least one waist strap, and the third vertex on said upper portion is coupled with said shoulder fastening component;

wherein said third vertex terminates approximately at a point positioned along a midline that extends substantially perpendicularly from a point approximately halfway along a line extending along the width of said lower portion.

2. The device of claim 1, further comprising a safety strap having a first end and a second end, said first end of said safety strap being coupled with said baby support member and said second end of said safety strap being adapted to operatively couple with one of said first shoulder strap and said second shoulder strap.

3. The device of claim 1, wherein said back support member is substantially planar and at least partially comprised of mesh material.

4. The device of claim 1, wherein said back support member further comprises a cutout proximate to the lower edge of said back support member and an elastomeric member coupled with the edges of said cutout, said elastomeric member adapted to allow unrestricted movement of a user when wearing said back support member.

5. The device of claim 1, further comprising a storage pouch coupled with said back support member.

6. The device of claim 1, wherein said back support member comprises an upper back portion and a lower back portion, said lower back portion being adapted to at least partially wrap around the midsection of a user when in use.

7. The device of claim 1, further comprising a mobile phone storage pocket coupled with at least one of said first shoulder strap and said second shoulder strap.

8. The device of claim 6, wherein said lower back portion forms said at least one waist strap.

9. The device of claim 1, wherein said baby support member comprises a maximum of one said shoulder fastening component.

10. The device of claim 1, wherein said first shoulder strap comprises a first adjustment mechanism configured to adjust the length of said first shoulder strap, and said second shoulder strap comprises a second adjustment mechanism configured to adjust the length of said second shoulder strap.

11. The device of claim 1, wherein when a user wears said back support member and a baby is placed in said baby support member, said first position is a first nursing position in which said baby's head is positioned proximate to said user's left breast, and said second position is a second nursing position in which said baby's head is positioned proximate to said user's right breast.

12. A baby carrier, comprising:

a back support member having a first shoulder strap extending from a first upper corner of said back support member to a first lower corner of said back support member, a second shoulder strap extending from a second upper corner of said back support member to a second lower corner of said back support member, a first waist strap partially extending from said first lower corner, and a second waist strap partially extending from said second lower corner, wherein a cutout is provided at the lower edge of said back support member between said first lower corner and said second lower corner, and said cutout is traversed by a flexible member coupled with said back support member;

a baby support member having a substantially triangular shape with a wide lower portion and a narrow upper portion, wherein said narrow upper portion terminates approximately at a point positioned along a midline that extends substantially perpendicularly from a point approximately halfway along a line extending along the width of said wide lower portion;

a first shoulder fastener coupled with said first shoulder strap;

a second shoulder fastener coupled with said second shoulder strap;

a third shoulder fastener coupled with said narrow upper portion of said baby support member, wherein said third shoulder fastener is configured to selectively couple with one of said first shoulder fastener and said second shoulder fastener at a time while the other one of said first shoulder fastener and said second shoulder fastener is not coupled with said baby support member;

a first waist fastener coupled with said first waist strap;

a second waist fastener coupled with said second waist strap;

a third waist fastener coupled with a first half of said wide lower portion of said baby support member, said third waist fastener being selectively coupled with said first waist fastener on said first waist strap; and a fourth waist fastener coupled with a second half of said wide lower portion of said baby support member, said fourth waist fastener being selectively coupled with said second waist fastener on said second waist strap.

* * * * *